United States Patent [19]

Caruso

[11] Patent Number: 4,459,914

[45] Date of Patent: Jul. 17, 1984

[54] IMPACT-DETONATED TIME DELAY FUSE

[76] Inventor: Anthony M. Caruso, 1620 Dallas Street, Aurora, Colo. 80010

[21] Appl. No.: 379,239

[22] Filed: May 17, 1982

[51] Int. Cl.[3] ..... F42C 19/08

[52] U.S. Cl. ..... 102/204; 102/275.9

[58] Field of Search ..... 102/204, 202, 202.13, 102/202.14, 202.5, 275.9, 275.11, 487, 488

[56] References Cited

U.S. PATENT DOCUMENTS

| | | | |
|---|---|---|---|
| 38,994 | 6/1863 | Tice | 102/204 |
| 405,647 | 6/1889 | Zalinski et al. | 102/202.13 |
| 1,310,844 | 7/1919 | Semple | 102/204 |
| 1,400,554 | 12/1921 | Johnson | 102/204 |
| 1,765,294 | 6/1930 | Bacon | 102/202.13 |
| 2,708,409 | 5/1955 | Borcher | 102/204 |
| 3,024,728 | 3/1962 | Trevorrow | 102/202.5 |
| 3,081,702 | 3/1963 | Klostermann et al. | 102/204 |
| 3,106,892 | 10/1963 | Miller | 102/275.9 |
| 3,169,483 | 2/1965 | Gawlick et al. | 102/204 |

FOREIGN PATENT DOCUMENTS

| | | | |
|---|---|---|---|
| 2900067 | 7/1980 | Fed. Rep. of Germany | 102/275.9 |

*Primary Examiner*—Charles T. Jordan

*Attorney, Agent, or Firm*—Charles E. Baxley

[57] ABSTRACT

Illustrative embodiments of the invention provide a visually inspectable primer and detonating charge cannister for a fuse for hand grenades and other munitions and explosives. The delay charge, moreover, is effectively symmetrical to permit reliable fuze operation in spite of incorrect assembly. The primer is sealed in its bore in the fuse body by means of a crimped ring which leaves the primer exposed to visual inspection to insure its correct orientation within the fuse. The delay charge is made symmetrical by removing the initiator charge from its usual location in the delay charge housing and placing the initiator in a detonating charge cannister. By placing the initiator next to the crimped end of a detonating charge cannister, the detonating charge also becomes not only amenable to visual inspection, but also less subject to deterioration through moisture attack.

8 Claims, 5 Drawing Figures

IMPACT-DETONATED TIME DELAY FUSE

This invention relates to fuses and, more particularly, to improved impact-detonated time-delay fuses for hand grenades, and the like.

There is an ever-present need for less expensive and more reliable fuses to detonate commercial and military explosives. More specifically, these fuses must satisfy a number of strict criteria. They must, for example, be: safe to manufacture, suitable for frequent inspections during assembly, capable of reliable operation in spite of incorrect assembly, activatable after long periods of storage in spite of environments that tend to promote deterioration, able to be stored separately from and quickly joined to the explosives that are to be detonated, and certain in establishing an essentially constant time-delay between primer detonation and the desired explosion to avoid either a premature explosion or a delayed explosion (that is, a "hangfire"), or possibly, no explosion at all (a "dud").

In the prior art a number of attempts have been undertaken to cope with many of those needs. Typical of these efforts is a delay type fuse or detonator manufactured by the Alfred Nobel Company of the Federal Republic of Germany. This fuse has an elongated hollow-cylindrical body that is closed on one transverse end by means of a thin metal web that is an integral part of the body. A standard pistol ammunition primer of the anvil type, similar to a Remington arms No. 5½ primer is pressed against the inner transverse surface of the web. To detonate this primer, a firing pin must strike the web and transmit sufficient force through that web and the cup enclosing the explosive material within that cup to cause this material to detonate. Although the integral web prevents gases generated within the fuse from escaping around the primer or expelling the primer from the end of the end of the fuse body, and thereby avoiding hangfire or misfire conditions, this design nevertheless does create new difficulties. Illustratively, the indirect application of firing pin force to the primer through the web reduces the fuse sensitivity and, if there is a gap between the primer and the web, may result in a complete misfire. Inverted insertion of the primer in the body during fuse assembly also is a problem that can be met only through painstaking manufacturing procedures, with substantially increased manufacturing costs. The presence of the integral web, in this circumstance, prevents a swift, inexpensive final visual inspection of the primer orientation within the fuse body.

To continue with the description of the Nobel fuse, the primer is pressed against the inner surface of the transverse web by means of a hollow-cylindrical primer seat, spacer (or flame passageway) and expansion chamber. Although the outer surface of the seat has a generally uniform outer diameter, its inner surface is recessed to form an angular flange that supports the primer against the web. A smaller diameter passageway provides communication between the primer recess and a large diameter expansion chamber.

A hollow-cylindrical housing for a delay and initiation charge abuts the expansion chamber in the spacer, the hollow portion of the housing being in general axial alignment with the expansion chamber and the primer.

The hollow portion of this housing that is next to the expansion chamber is filled with a delay charge, or a train of pyrotechnic powder which, through burning at a predetermined rate, should establish the desired delay between the instant of primer detonation and the time that the grenade, or other explosive, actually bursts. The opposite end of this hollow-cylindrical housing is filled with still another charge, an "initiator", that explodes in response to the arrival of the flame front as it completes burning progressively along the length of the delay charge. Wadding fills the balance of the hollow portion that exists between the initiator and the adjacent end of the housing.

Clearly, inverted assembly of the delay and initiating charge housing that would place the initiator next to the expansion chamber is a genuine possibility, unless further costly manufacturing procedures are adopted. A failure to detect an improperly inserted delay and initiating charge housing, however, can produce the most undesirable result, a premature explosion in which there is almost no delay between striking the primer and the explosion of the entire grenade or bursting charge.

The open end of the Nobel fuse body then receives a thin felt washer. An "opercule", or cup-shaped retainer that has an aperture in its base is pressed against the washer, the aperture in the opercule being in general axial alignment with the central bore in the washer and the wadding that seals the end of the delay and initiating charge housing.

The opercule and the associated volume in the remaining central portion of the fuse body is loaded with a metered and compressed detonating charge. Because this detonating charge is loaded directly into the fuse body, it is not capable of being independently inspected or tested. This introduces a further source of potential fuse malfunction.

A thin wad is pressed into the end of the fuse body, bearing directly against the detonating charge. The ends of the fuse body are crimped over the detonating charge wad and the crimped end and wad are lacquered to form a waterproof barrier. Because compressed materials tend to "creep", or undergo slight changes in shape and size, the lacquer may, in time, fracture and create passageways for moisture that eventually will degrade the performance of the fuse.

These difficulties that have characterized the prior art are overcome, to a great extent through the practice of the invention. Illustratively, the transverse end at the detonator side of the fuse body does not have a thin web, but has a internally flanged and centrally disposed bore into which the primer is press-fitted with a light force to prevent gas leaks or primer expulsion after detonation. To insure primer retention and gas-tight integrity, a ring of fuse body material that protrudes longitudinally from the periphery of the primer bore is pressed, or crimped, over the cup that encloses the explosive material. If further desired, a suitable cement or adhesive can be applied to bond the cup to the surrounding wall of the primer bore.

As a consequence, firing pin impact is applied directly to the primer cup and the orientation and position of the primer within the fuse body is immediately subject to visual inspection. In this manner, several causes of fuse defects are eliminated and quality assurance inspection costs are significantly reduced.

By drilling recesses of suitably different diameters in the portion of the fuse body that is adjacent to the primer bore, the flame passage and expansion chamber become integral parts of the fuse body. Thus, production costs are further reduced through the elimination of the hollow-cylindrical primer seat, spacer and expansion chamber.

An annular flange, or shelf, is formed within the fuse body at the end of the expansion chamber to position a hollow-cylindrical delay charge body relative to the primer. The fuse body is worked to establish a shrink fit with the outer surface of the delay charge body. This close fit between the adjoining wall of the fuse body and the outer surface of the delay charge body compels the flame or hot primer gases from the expansion chamber to concentrate on the delay charge that fills the hollow central portion of the delay charge body. Bypassing the delay charge by permitting the hot primer gases to flow through gaps between the fuse body and the delay charge body is thereby eliminated. Consequently, a further source of premature explosion is eliminated inasmuch as the flame from the primer cannot reach the detonating charge. A further benefit of this feature of the invention is the fact that the delay charge body contains only the delay charge. As a result, an inadvertent backward insertion of the delay charge body into the fuse body will not impose an undesirable effect on fuse operation.

A specific feature of the invention is the preparation of the detonating charge as an integral unit that contains its own initiating charge. Typically, a metal cannister that fits within the fuse body is loaded with a detonating charge. One end of this cannister, moreover, has an aperture that is in general axial alignment with the delay charge. The portion of the volume of this cannister that is near to the aperture is filled with an initiating charge. After inserting the loaded cannister into the fuse body, the end of the fuse body is crimped over the exposed transverse end of the cannister. Only continuous metal surfaces are exposed to the atmosphere. Ergo, the eventual deterioration of the fuse due to a breakdown in the atmospheric moisture seal is avoided and the storage life of the fuse is lengthened considerably.

Thus there is provided in accordance with the invention an improved fuse that provides greater reliability in performance, longer storage life, easier quality assurance inspection and significantly lower manufacturing costs. For a more complete appreciation of the invention, attention is invited to the following detailed description of preferred embodiments of the invention, taken with the accompanying drawing. The scope of the invention, however, is limited only through the claims.

DETAILED DESCRIPTION OF THE PREFERRED EMBODIMENTS

Figure 1:
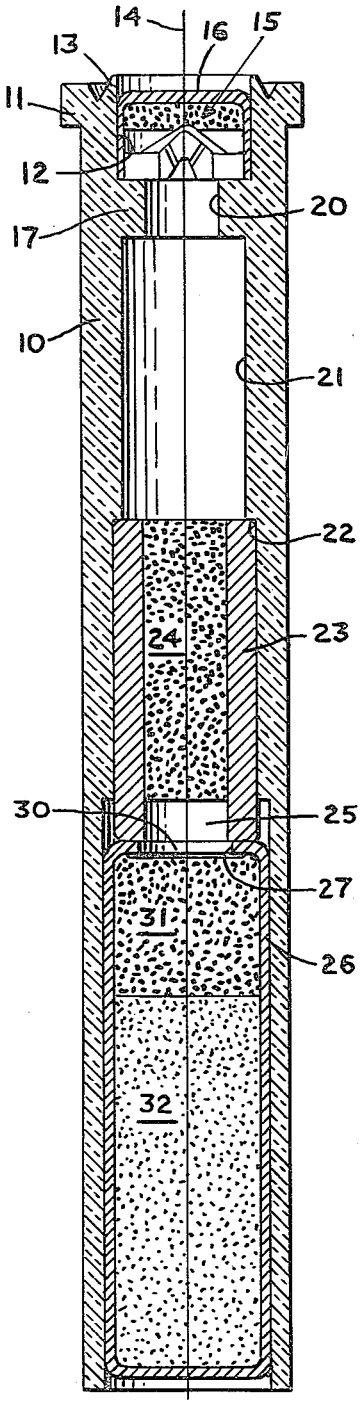
FIG. 1 is an illustrative embodiment of the invention, shown in full section.

For a more detailed understanding of the invention, attention is invited to FIG. 1 which shows an elongated, hollow-cylindrical fuse body 10. In accordance with a salient feature of the invention, an end of the fuse body 10 is provided with a transverse flange 11 in which a centrally disposed primer bore 12 is formed. The periphery of the primer bore 12 has a longitudinally protruding ring 13 that is concentric with longitudinal axis 14. If desired, the flange 11 can be threaded to adapt the fuse to other types of munitions or explosives.

A percussion primer 15 is gently, albeit snugly, pressed into the primer bore 12. If preferred, a suitable adhesive can be applied to the contacting surface of the primer 15 and the surrounding wall that forms the bore 12 in order to more securely seat the primer within the bore to either prevent primer gases from escaping between these two surfaces or to prevent the primer 15 from being expelled from the bore when the primer is detonated.

The primer 15 shown in FIG. 1 is a standard anvil type pistol ammunition primer, similar to the Remington Arms No. 5½ primer. This primer 15 is housed in an inverted metal cup 16, the rim of which is seated upon an internal flange 17 that is formed within the fuse body 10 to establish a spacer or flame passage 20 through from the primer 15 to a much larger diameter expansion chamber 21.

An annular recess 22 within the fuse body 10 forms a stop for a delay charge housing 23. As illustrated, the recess 22 also defines the end of the expansion chamber 21. It will be recalled that the establishment of an extremely close fit between the outer cylindrical surface of the delay charge housing 23 and the mating inner surface of the fuse body 10 is a significant aspect of the invention. This close, tight fit prevents the flame from the primer 15 from bypassing a delay charge 24 within the hollow center of the housing 23 by flowing through gaps between the housing 23 and the fuse body 10. Accordingly, upon seating the delay charge housing 23 on the annular recess 22, the adjacent outer surface of the fuse body 10 is worked to establish the desired tight contact between the adjoining surfaces.

Note in FIG. 1, that a small void space 25 is provided within the delay charge housing 23. The space 25 is formed in the delay charge housing 23 for manufacturing purposes only, and has no bearing upon the function of the fuse. As a consequence, the orientation of the delay charge housing 23 within the fuse body 10 relative to the primer 15 is immaterial and will not adversely affect the function of the fuse. In this manner, the need to establish careful and expensive manufacturing procedures to insure correct delay charge orientation during fuse assembly is eliminated.

The base of the delay charge housing 23 bears against a crimped end of a generally cylindrical detonating charge cannister 26. The crimped end of the cannister 26 forms a centrally disposed aperture 27 that is essentially concentric with the longitudinal axis 14 of the fuse body 10.

The aperture 27 is sealed by means of a metal foil disc 30, the peripheral portion of which is pressed between the crimped end of the cannister 26 and an initiating charge 31. The balance of the volume within the cannister 26 is filled with a detonating charge 32.

A snug fit between the cannister 26 and the receiving wall of the fuse body 10 is desirable. It should be observed, moreover, that the cannister 26 and the metal foil 30 all combine to protect the initiating charge 31 and the detonating charge 32 from moisture attack, as well as to provide a number of other important benefits. For example, by combining the initiating charge 31 with the detonating charge 32 the problem in the prior art with respect to the critical nature of the orientation of the delay charge housing relative to the primer is eliminated. Further, the cannister 26 and its encased charges 31, 32 can be inspected as a unit before insertion into the fuse body 10, in contrast to the prior technique of merely loading the detonating charge into the fuse body without providing any means to inspect the quality of the product. The cannister 26 also is amenable to quick, accurate and inexpensive visual inspection after assembly into the fuse body 10. It is only necessary to insure that the foil 30 is not exposed in the base of the fuse to assure proper orientation of the cannister 26 after insertion relative to the primer 15.

Figure 3:
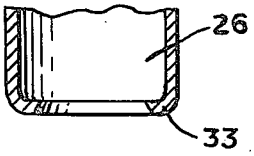
FIG. 3 is a portion in full section of the device shown in FIG. 1 in a crimped condition.

As shown in FIG. 3, end 33 of the fuse body 10 is crimped over the base of the detonating charge cannister 26 to press the assembled fuze components together.

Figure 2:
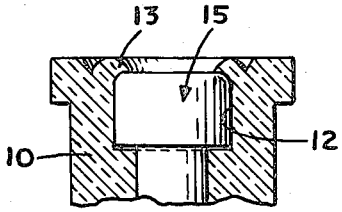
FIG. 2 is a portion in full section of the device shown in FIG. 1 in a crimped condition.

Attention is now invited to FIG. 2 of the drawing which shows an additional feature of the invention, in which the ring 13 that is peripheral to the primer bore 12 is crimped over the base of the primer 15 in order to provide a mounting for the primer 15 that will prevent the primer 15 from being expelled from the fuse body 10 when the primer is detonated.

Figure 4:
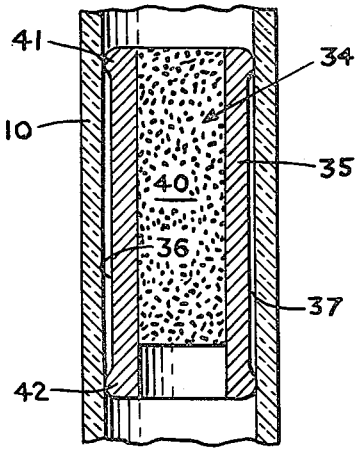
FIG. 4 is an alternative embodiment of a delay charge housing.

Turning now to FIG. 4, an alternative embodiment of a delay charge 34 is shown. To reduce thermal conductivity between delay charge housing 35 and the adjoining wall of the fuse body 10 the outer cylindrical surface of the housing 35 is provided with an undercut 36 of generally uniform diameter through most of its length between its longitudinal ends. The undercut 36 thereby provides a thermal barrier 37 in the form of a void, or separation between the outer surface of the housing 35 and the wall of the fuse body 10.

It will be recalled, however, that the flame from the primer (not shown in FIG. 4), if permitted to bypass delay charge 40 by flowing between the delay charge housing 35 and the fuse body 10, will cause a premature explosion, Accordingly, to provide a hot gas check for the housing 35, beaded ends 41, 42 are formed at the longitudinal extremities of the delay charge housing 35. The beads 41, 42 form a suitably tight contact with the inner wall of the fuse body 10 to prevent primer flame bypass through the thermal barrier 37 and thus prevent premature explosion and thermal isolation for the delay charge 34.

Figure 5:
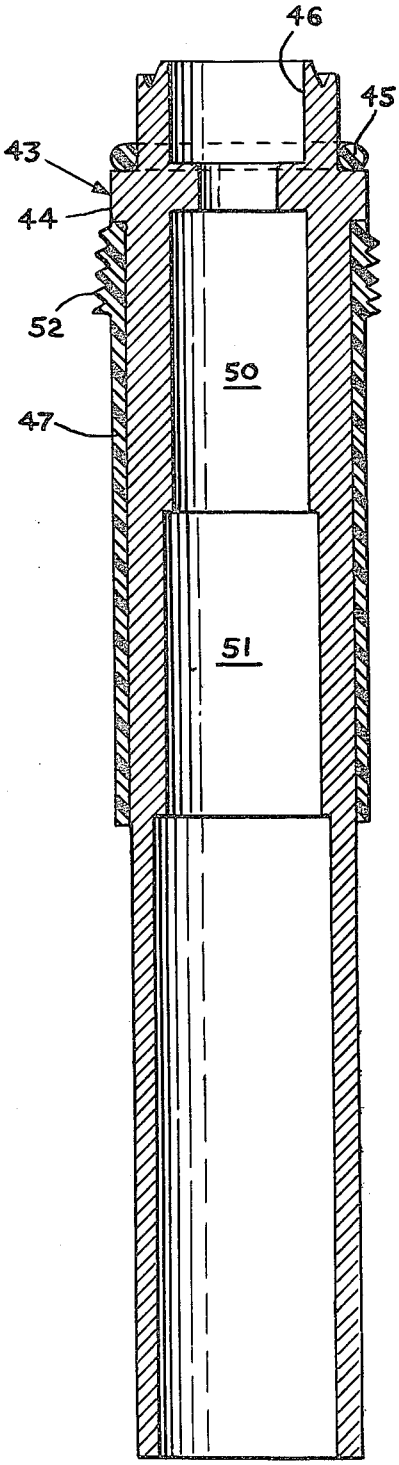
FIG. 5 is an alternative embodiment of a fuse body that discloses principles of the invention.

A further embodiment of the invention is shown in FIG. 5. A fuse body 43 has a flange 44 near its primer (not shown in FIG. 5). The flange 44 provides a seat for an O-ring 45 that is in engagement with the longitudinal wall of the fuse body 43 that forms primer bore 46.

The transverse surface of the flange 44 opposite to that on which the O-ring 45 is seated forms a stop for an insulating sleeve 47 of plastic, or the like. The sleeve 47 is close fitting and encases the outer surface of the fuse body 43 for a length that is about equal to the length of expansion chamber 50 and a portion 51 that houses the delay charge and its housing (not shown in FIG. 5).

Threading 52 is formed on the sleeve 47 near the flange 44 to permit the fuse to be operatively joined to a main explosive charge.

In operation, a suitable blow from a firing pin, or the like to percussion primer 15 (FIG. 1) causes the primer to detonate. Because of the crimped ring 13 (FIG. 2), the primer is not expelled from the fuse body 10 and the primer flame, or hot gases, flow through the flame passage 20 to the expansion chamber 21. Upon issuing from the expansion chamber 21, the tight seal between the delay charge housing 23 and the adjoining inner wall of the fuse body 10 causes the powder train in the delay charge 24 to ignite and to burn for a predetermined period of time before reaching the detonating charge cannister 26.

The flame, or hot gases, from the delay charge 24 burns through the foil disc 30 to activate the initiating charge 31 which charge, in turn, causes the detonating charge 32 to burst with sufficient brisance to explode the main charge (not shown in the drawing).

Thus, there is provided a relatively simple, inexpensive and reliable fuse structure that provides improved features for visual quality assurance checking, reliable operation in spite of incorrect assembly, and the like.

I claim:

1. A fuse comprising an elongated hollow-cylindrical fuse body having a primer bore penetrating said body formed at one end thereof, a deformable ring circumscribing said primer bore for crimping over said bore, a flame passage formed in said fuse body, an expansion chamber formed in said fuse body in gaseous communication with said primer bore through said flame passage, an annular recess formed in said fuse body to terminate said expansion chamber and to provide a stop, a delay charge housing having one longitudinal end bearing against said stop, a detonating charge cannister in direct abutting engagement with another longitudinal end of said delay charge housing, said cannister having an aperture formed in longitudinal alignment with said delay charge housing and in gaseous communications therewith, an initiating charge adjacent to said cannister aperture, a detonating charge also in said cannister for activation by said initiating charge, and a deformable end of said fuse body for crimping over said detonating charge cannister in order to retain said cannister and said delay charge housing within said fuse body.

2. A fuse according to claim 1 wherein said delay charge housing further comprises a generally cylindrical outer surface, and said fuse body has an inner surface adjoining said delay charge housing that has been worked into close contact therewith.

3. A fuse according to claim 1 wherein said delay charge housing further comprises an undercut longitudinal outer surface thereof to establish a thermal barrier between said delay charge housing and said fuse body and a pair of longitudinally spaced beads at opposite ends of said delay charge housing to establish gas checks between said delay charge housing and said fuse body.

4. A fuse according to claim 1 further comprising a primer seated within said primer bore and an adhesive bonding said primer to the fuse body wall that forms said primer bore in order to form a gas check between said primer bore and said primer.

5. A fuse according to claim 1 further comprising a sleeve encasing only a portion of the outer surface of said fuse body, said sleeve providing thermal insulation for said fuse body.

6. A fuse according to claim 5 wherein said sleeve further comprises external threading over a portion of its surface.

7. A fuse according to claim 1 further comprising a transversely disposed flange formed on said fuse body and from which said deformable ring is formed.

8. A fuse according to claim 5 further comprising threading on the outer surface of said sleeve near said primer bore.

* * * * *